US005662049A

United States Patent [19]

Shimizu et al.

[11] Patent Number: 5,662,049

[45] Date of Patent: Sep. 2, 1997

[54] COMBUSTION METHOD AND APPARATUS

[75] Inventors: Makoto Shimizu, Yokosuka; Yoshio Takeuchi, Yokohama; Minoru Asai, Kamagaya; Takeichi Kondo, Kashiwa; Hiroshi Aramaki; Masanobu Naito, both of Yokohama, all of Japan

[73] Assignee: Ishikawajima-Harima Jukogyo Kabushiki Kaisha, Tokyo-to, Japan

[21] Appl. No.: 450,174

[22] Filed: May 25, 1995

[30] Foreign Application Priority Data

| | | | |
|---|---|---|---|
| May 30, 1994 | [JP] | Japan | 6-116848 |
| Nov. 14, 1994 | [JP] | Japan | 6-279040 |
| Apr. 4, 1995 | [JP] | Japan | 7-78810 |

[51] Int. Cl.[6] ..... F23G 5/00

[52] U.S. Cl. ..... 110/245; 110/346

[58] Field of Search ..... 110/245, 244, 110/263, 348, 346; 422/139; 165/104.16

[56] References Cited

U.S. PATENT DOCUMENTS

| | | | |
|---|---|---|---|
| 4,080,909 | 3/1978 | Nalbandian et al. . | |
| 4,700,636 | 10/1987 | Vogt et al. | 110/245 |
| 4,938,156 | 7/1990 | Yahata | 110/346 |
| 5,425,317 | 6/1995 | Schaub et al. | 110/346 |
| 5,546,875 | 8/1996 | Selle et al. | 110/245 |
| 5,562,884 | 10/1996 | Oakes et al. | 110/245 |

FOREIGN PATENT DOCUMENTS

| | | |
|---|---|---|
| 0 381 946 | 8/1990 | European Pat. Off. . |
| 0 455 624 | 11/1991 | European Pat. Off. . |
| 4-313611 | 11/1992 | Japan . |
| 5-10514 | 1/1993 | Japan . |
| 6-201115 | 7/1994 | Japan . |
| 6-201116 | 7/1994 | Japan . |
| 6-201118 | 7/1994 | Japan . |
| WO93/18341 | 9/1993 | WIPO . |

*Primary Examiner*—John T. Kwon

*Attorney, Agent, or Firm*—Oblon, Spivak, McClelland, Maier & Neustadt, P.C.

[57] ABSTRACT

Unreacted gas generated at outside is introduced through a gas inlet tangentially into a secondary combustion chamber with a substantially cylindrical side wall, so that a spiral ascending flow of the unreacted gas is generated in the chamber. A bulk material in the chamber is blown up by the unreacted gas introduced through the gas inlet to be circulated in the chamber so as to substantially completely burn unburnt solids entrained in the unreacted gas.

5 Claims, 12 Drawing Sheets

COMBUSTION METHOD AND APPARATUS

BACKGROUND OF THE INVENTION

The present invention relates to a combustion method and apparatus.

A combustion apparatus such as waste incinerator is generally used in such a manner that domestic waste and other refuse are charged into a combustion chamber and are burnt. In the chamber, the waste and refuse are thermally decomposed and unreacted gas generated by the thermal decomposition is burnt. Through these two processes, waste and refuse are burnt.

In a conventional combustion apparatus, these two types of reactions, i.e. thermal decomposition of the waste and combustion of unreacted gas, are carried out simultaneously in one and the same combustion chamber, which tends to cause insufficient execution of both thermal decomposition of the waste and combustion of the unreacted gas.

Thus, in the thermal decomposition of waste and refuse, temperature change due to influence of the combustion of unreacted gas tends to make the rate of thermal decomposition unstable.

In the combustion of unreacted gas, air may be insufficiently mixed with the gas in the combustion chamber, resulting in incomplete combustion of unreacted gas and generation and discharge of harmful substances to the atmosphere.

For this reason, a combustion apparatus has been proposed in recent years in which the existing combustion chamber is used as a primary combustion chamber and a secondary combustion chamber is added. The primary combustion chamber is exclusively used for thermal decomposition of the waste whereas unreacted gas generated by thermal decomposition is guided to the secondary combustion chamber for complete combustion of the unreacted gas.

FIG. 1 represents a currently proposed combustion apparatus having a secondary combustion chamber.

In the figure, reference numeral 1 denotes a primary combustion chamber such as waste incinerator having a waste inlet 2 and a hopper 3 at its upper and lower portions, respectively; 4, a plurality of horizontal air distribution pipes mutually spaced and arranged above the hopper 3; 5, a fluidized bed formed by a fluidization medium such as fluidization sand fluidized by air from the pipes 4; and 6, a burner mounted on an intermediate portion of the chamber 1 and directed to the fluidized bed 5.

Reference numeral 7 denotes a medium outlet on a lower end of the hopper 3; 8, a medium inlet on the intermediate portion of the chamber 1; 9, a medium circulating passage such as a bucket elevator for connection of the outlet 7 with the inlet 8; 10, a medium conveyor at a entrance side of the passage 9; and 11, a sieve at exit side of the conveyor 10.

Reference numeral 12 represents a generally cylindrical secondary combustion chamber above the primary combustion chamber 1 and having a gas outlet 13 and a hopper 14 on its upper and lower portions, respectively; 15, unreacted gas generated in the chamber 1 and having unburnt solids 16 entrained therein; and 17, an ash outlet on a lower end of the hopper 14.

Reference numeral 18 denotes a throttled passage through which the unreacted gas 15 rises up from the chamber 1 to the chamber 12; and 19, a connection tangentially connected to a lower portion of a side wall of the chamber 12. Reference numeral 20 represents an air passage connected to a ventilator 21 located externally; 22, a primary air passage branched off from the passage 20 for supplying air to the pipes 4; 23 and 24, secondary air passages branched off from the passage 20 for supplying air to points on the passage 18; and 25, 26 and 27, valves in the passages 22, 23 and 24, respectively.

By operating the ventilator 21, air is supplied to the pipes 4 through the passages 20 and 22 to fluidize the bed 5 in the chamber 1 while the bed 5 is preheated by the burner 6. Under this condition, waste is charged through the inlet 2 into the chamber 1.

The waste charged into the chamber 1 is then thermally decomposed in the preheated fluidized bed 5 and the unreacted gas 15 and the unburnt solids 16 such as char are generated by the thermal decomposition.

With the air being fed through the pipes 4 to the chamber 1, the unburnt solids 16 are burnt and the resultant combustion heat promotes thermal decomposition of the waste.

The unreacted gas 15 generated by thermal decomposition of the waste rises up to the secondary combustion chamber 12 via the passage 18 and the connection 19. As a result, in the chamber 1, the waste can be thermally decomposed at a given rate without being influenced by combustion of the unreacted gas 15.

On the other hand, the unreacted gas 15 and part of the unburnt solids 16 directed through the passage 18 and the connection 19 toward the chamber 12 are fed, at the passage 18, with the air from the passages 23 and 24 and are mixed with the same to some extent and then are tangentially introduced into the generally cylindrical secondary combustion chamber 12.

In the chamber 12, a spiral ascending flow is formed by the unreacted gas 15 mixed with the air and mixing of the unreacted gas 15 with the air is further promoted by the spiral ascending flow. In addition, retention time necessary for combustion of the unreacted gas 15 in the chamber 12 is sufficiently assured by the spiral flow. During this retention time, complete combustion of the unreacted gas 15 occurs, which will reduce generation of harmful substances due to incomplete combustion.

Combustion gas generated by the combustion is discharged through the outlet 13 on the upper end of the chamber 12.

Apart from the above, in the chamber 1, part of the medium constituting the fluidized bed 5 is sent through the outlet 7 and the conveyor 10 to the sieve 11 where unburnt materials are removed from the medium. Then, the medium is circulated via the passage 9 and the inlet 8 to the chamber 1.

Further, the unburnt solids 16 rising up through the passage 18 and entrained in the unreacted gas 15 are centrifuged by the spiral ascending flow in the chamber 12 and are discharged as ashes through the outlet 17 on the lower end of the hopper 14.

The secondary combustion chamber in the above-mentioned combustion apparatus has the following problem.

Since thermal decomposition of the waste and combustion of the unreacted gas 15 are exclusively carried out in the first and secondary combustion chambers 1 and 12, respectively, the waste can be burnt under the condition closer to complete combustion. However, the combustion gas discharged through the outlet 13 at the upper end of the chamber 12 still contains carbon monoxide at an concentration of about 10 ppm. This is because the unburnt solids 16 entrained in the unreacted gas 15 are not completely burnt out in the chamber 12. There is still room for further improvement on the combustion condition in the secondary combustion chamber 12.

It is therefore an object of the present invention to provide a combustion apparatus which can carry out substantially complete combustion.

BRIEF SUMMARY OF THE INVENTION

The present invention provides a combustion method which comprises tangentially guiding unreacted gas with unburnt solids entrained therein at a lower portion of a side wall of a generally cylindrical secondary combustion chamber to thereby generate a spiral ascending flow of the unreacted gas in the secondary combustion chamber and form a group of the unburnt solids with elevated particle concentration along the side wall of the secondary combustion chamber by centrifugal force of the spiral ascending flow, and charging a fluidization medium into the side wall of the secondary combustion chamber to contact the medium with said group, thereby completely burning the unburnt solids.

The present invention also provides a combustion apparatus comprising a secondary combustion chamber with a cylindrical side wall, said secondary combustion chamber having at a lower portion of the side wall a gas inlet through which unreacted gas with unburnt solids entrained therein is directed tangentially into the chamber, said chamber further having a hopper at its portion lower than the gas inlet, said hopper having bulk material stacked therein up to such a height that the bulk material can be blown upward by the unreacted gas introduced through the gas inlet.

The gas inlet may be inclined downward to be directed toward the bulk material stacked in the hopper.

The secondary combustion chamber may further have a bulk material feeder with a bulk material feed valve, a drawing mechanism at a lower end of the hopper for drawing the bulk material out of the chamber, a bulk material level regulating valve, a temperature sensor and a computation controller for comparing a sensed temperature signal from the temperature sensor with a reference temperature inputted to an input setting unit to selectively issue a control signal to the bulk material feed valve so as to charge the bulk material to the hopper and a control signal to the bulk material level regulating valve so as to discharge part of the bulk material out of the chamber.

The secondary combustion chamber may further have a bulk material feeder with a bulk material feed valve, a carbon monoxide concentration sensor at a gas outlet of the secondary combustion chamber and a computation controller for comparing a sensed carbon monoxide signal from the carbon monoxide concentration sensor with a reference carbon monoxide concentration inputted to an input setting unit to issue a control signal to the bulk material feed valve so as to charge the bulk material to the hopper.

Further, the secondary combustion chamber may have a denitrating agent feeder with a denitrating agent feed valve, a nitrogen oxide concentration sensor at a gas outlet of the secondary combustion chamber and a computation controller for comparing a sensed nitrogen oxide concentration signal from the nitrogen oxide concentration sensor with a reference nitrogen oxide concentration inputted to an input setting unit to issue a control signal to the denitrating agent feed valve so as to charge a denitrating agent to the hopper.

The present invention also provides a combustion apparatus comprising a secondary combustion chamber with a cylindrical side wall, said secondary combustion chamber having at a lower portion of the side wall a gas inlet through which unreacted gas is directed tangentially into the chamber, a bulk material circulation passage for connecting between a lower end of the secondary combustion chamber and the side wall of the secondary combustion chamber and a bulk material circulating unit in the bulk material circulation passage.

In this case, a position of connecting the bulk material circulation passage to the side wall of the secondary combustion chamber may be higher than a position of connecting the gas inlet to the side wall of the secondary combustion chamber.

The present invention further relates to a combustion apparatus comprising a fluidized bed type primary combustion chamber, a secondary combustion chamber provided separately from the primary combustion chamber, a gas inlet for tangentially guiding unreacted gas with unburnt solids entrained therein generated in the primary combustion chamber to a lower portion of a side wall of the secondary combustion chamber, a medium circulation passage for connecting a medium outlet on a lower end of the primary combustion chamber to the side wall of the secondary combustion chamber and a medium outlet on a hopper at the lower portion of the secondary combustion chamber connected to the primary combustion chamber.

In this case, a position of connecting the medium circulation passage to the side wall of the secondary combustion chamber may be higher than a position of connecting the gas inlet to the side wall of the secondary combustion chamber.

The secondary combustion chamber maybe provided above or on a side of the primary combustion chamber.

The secondary combustion chamber may have therein a lower complete combustion zone above the hopper as well as an upper chemical agent reaction zone, a chemical agent injection nozzle being mounted on the side wall of the secondary combustion chamber at a boundary between the zones. In this case, the chemical agent injected from the injection nozzle maybe a denitrating or desulfurizing agent.

According to the present invention, the unreacted gas in incomplete combustion state is tangentially guided to the generally cylindrical secondary combustion chamber via the gas inlet.

The unreacted gas tangentially introduced into the secondary combustion chamber forms a spiral ascending flow along the side wall of the secondary combustion chamber.

In this case, bulk material (powder and grain materials) is stacked in the hopper at the lower portion of the secondary combustion chamber. The stacked bulk material is blown upward by the introduced unreacted gas and is moved upward with the spiral ascending flow. If the gas inlet is designed to have downward inclination, dispersed quantity of the bulk material in the secondary combustion chamber will be increased.

The above spiral ascending flow sufficiently assures retention time of the unreacted gas in the secondary combustion chamber.

With sufficient retention time assured, the unreacted gas is completely burnt to suppress generation of harmful substances such as dioxin due to incomplete combustion.

Similarly, the unburnt solids such as char entering into the secondary combustion chamber together with the unreacted gas from the gas inlet are entrained in and moved spirally upward by the spiral ascending flow of the unreacted gas along inner wall of the secondary combustion chamber.

The unburnt solids entrained in and moved up by the unreacted gas are separated from the unreacted gas when velocity of the spiral ascending flow of the unreacted gas decreases in the upper portion of the secondary combustion chamber. The solids fall by their own weight and are again moved up with an upstream spiral ascending flow with higher velocity. Thus, the unburnt solids are circulated in the secondary combustion chamber and forms an internal circulating flow in the secondary combustion chamber.

This internal circulation flow makes retention time of the unburnt solids in the chamber sufficiently longer, which improves combustion status of the unburnt solids.

Moreover, by centrifugal force of the spiral ascending flow, the unburnt solids are brought together along the inner wall of the secondary combustion chamber into a group of the unburnt solids with elevated particle concentration. By means of the bulk material blown upward by the unreacted gas in the group of the unburnt solids with the elevated particle concentration along the inner wall and circulated together with the unburnt solids along with the internal circulating flow, surfaces of the unburnt solids are removed and new surfaces constantly appear, which promotes combustion of the unburnt solids.

As described above, even when the unburnt solids are difficult to burn, the better condition for combustion can be attained, which may be ten or more times as great as that of the prior art. The combustion gas discharged through the gas outlet on the upper end of the secondary combustion chamber conventionally contains abut 10 ppm of carbon monoxide, whereas, according to the present invention, it is possible to reduce carbon monoxide concentration in the combustion gas to less than 1 ppm or very close to the level of 0 ppm.

In addition, the unburnt solids and the bulk material flows intensively along the side wall of the secondary combustion chamber due to centrifugal force, which has an effect of cleaning up inside the secondary combustion chamber.

The above arrangement to stack the bulk material in the hopper is suitable for a case where the secondary combustion chamber is designed in smaller size.

The good combustion condition as described above can be attained without controlling the level of the bulk material stacked in the hopper or dispersed quantity of the bulk material in the chamber. The following control may be conducted to achieve the better combustion.

Specifically, temperature at a portion (where the temperature reaches the highest value) at approximately the same height as mounting position of the gas inlet on the lower portion of the side wall of the secondary combustion chamber is sensed by a temperature sensor. A sensed temperature signal from the temperature sensor is sent to a computation controller which compares it with an input signal such as a reference temperature from an input setting unit.

In a case where the comparison reveals the value of the sensed temperature signal to be higher than the reference temperature, the computation controller issues a control signal to the bulk material feed valve to open the same to charge a large quantity of cool bulk material in the bulk material feeder into the hopper, thereby decreasing the temperature of the secondary combustion chamber and preventing the unburnt solid and/or ashes from being molten and attached to the inner wall of the secondary combustion chamber. This is because, when the secondary combustion chamber is too hot, there is a possibility that unburnt solids such as char having low melting point and introduced together with the unreacted gas, ashes introduced into the secondary combustion chamber together with the unburnt solids and/or ashes generated from the combustion of the unburnt solids may be molten and attached on the inner wall of the chamber.

When the bulk material feeder is installed along the chamber wall at the upper end of the secondary combustion chamber, the bulk material falls down along the inner wall of the chamber, which attains an effect of cleaning up inside the secondary combustion chamber.

In general, increase of temperature in the chamber will tend to increase quantity of nitrogen oxides generated. Charging of a large quantity of the cool bulk material into the chamber to decrease the temperature in the chamber can also suppress generation of nitrogen oxide.

On the contrary, in a case where that the value of the sensed temperature signal from the temperature sensor is lower than the reference temperature, it means that combustion efficiency of the secondary combustion chamber is in decreasing tendency. Therefore, the computation controller issues a control signal to the bulk material level regulating valve to send the air from the ventilator to the drawing mechanism via the drawing air passage, thereby discharging part of the bulk material in the hopper out of the chamber. As a result, the stacked quantity of the bulk material in the hopper is reduced and the temperature inside the furnace is increased, leading to improve the combustion efficiency.

In general, decrease of temperature in the chamber will tend to increase quantity of carbon monoxide generated. Therefore, the computation controller issues a control signal to the bulk material feed valve to open the same, thereby charging a small quantity of the bulk material in the bulk material feeder into the hopper. This increases temperature in the chamber and suppresses the generation of carbon monoxide.

Similarly, concentration of carbon monoxide is sensed by the carbon monoxide concentration sensor at the gas outlet of the secondary combustion chamber. The sensed carbon monoxide concentration signal from the sensor is sent to the computation controller which compares it with an input signal such as reference carbon monoxide concentration from the input setting unit.

In a case where the comparison reveals that value of the sensed carbon monoxide signal is higher than the reference carbon monoxide concentration, it means that the dispersed quantity of the bulk material inside the chamber is in shortage and combustion performance of the unburnt solids is low. Therefore, the computation controller issues a control signal to the bulk material feed valve to open the same, thereby charging a small quantity of the bulk material in the bulk material feeder into the hopper. This increases dispersed quantity of the bulk material in the chamber and promotes decomposition and combustion of the unburnt solids.

On the contrary to the above, in a case where the value of the sensed carbon monoxide concentration signal is lower than the reference carbon monoxide concentration, it means that burning condition is good and there is no need to perform control operation.

Similarly, concentration of nitrogen oxides is sensed by a nitrogen oxide sensor at the gas outlet of the secondary combustion chamber and the sensed nitrogen oxide concentration signal from the sensor is sent to the computation controller which compares it with an input signal such as reference nitrogen oxide concentration from the input setting unit.

In a case where the comparison reveals that the value of the sensed nitrogen oxide concentration signal is higher than the reference nitrogen oxide concentration, the computation controller issues a control signal to the denitrating agent feed valve to inject the denitrating agent in the denitrating agent feeder into the chamber, thereby decreasing the nitrogen oxides.

On the contrary to the above, in a case where the value of the sensed nitrogen oxide concentration signal is lower than the reference nitrogen oxide concentration, it means that good burning condition is good and there is no need to perform control operation.

According to another aspect of the invention, the bulk material in the bulk material circulating passage for the secondary combustion chamber is blown upward to a bulk material inlet located at a position higher than a connecting position of the gas inlet on the side wall of the secondary combustion chamber and is charged through the bulk material inlet into the secondary combustion chamber.

The charged bulk material through the bulk material inlet is partially blown upward by the unreacted gas in the secondary combustion chamber and forms an internal circulating flow together with the unburnt solids in the secondary combustion chamber, thereby promoting combustion of the unburnt solids.

The remaining bulk material falls down in the secondary combustion chamber due to its own weight and is taken through the bulk material outlet to the bulk material circulating passage for the secondary combustion chamber and is circulated externally with respect to the secondary combustion chamber.

In this case, the lower portion of the secondary combustion chamber is cleaned up by the bulk material which falls down in the secondary combustion chamber.

On the other hand, from the unburnt solids entrained in the unreacted gas entering through the gas inlet into the secondary combustion chamber, coarse particles, i.e. unburnt coarse solid particles, are separated by centrifugal force and fall down in the secondary combustion chamber.

Then, the unburnt coarse particles are circulated externally in the circulating passage together with the bulk material and are pulverized in the circulating passage by the bulk material. After the particles have been pulverized to some extent, these are entrained in the internal circulating flow generated in the secondary combustion chamber and are completely burnt.

The above arrangement to circulate the bulk material externally of the secondary combustion chamber is especially suitable for the case where the secondary combustion chamber of larger size is used.

According to still further aspect of the invention, the fluidization medium constituting the fluidized bed in the primary combustion chamber is sent to the secondary combustion chamber through the medium circulating passage and is externally circulated. Therefore it is possible to utilize the medium used in the primary combustion chamber so as to achieve complete combustion of the unburnt solids in the secondary combustion chamber and to cleanup the secondary combustion chamber without specially preparing bulk material for the secondary combustion chamber.

The primary and the secondary combustion chambers may be arranged in vertical direction or in horizontal direction.

DETAILED DESCRIPTION OF THE PREFERRED EMBODIMENTS

Description will be given on preferred embodiments of the present invention in connection with the drawings.

FIGS. 3 to 8 show a first embodiment of the present invention.

Figure 1:
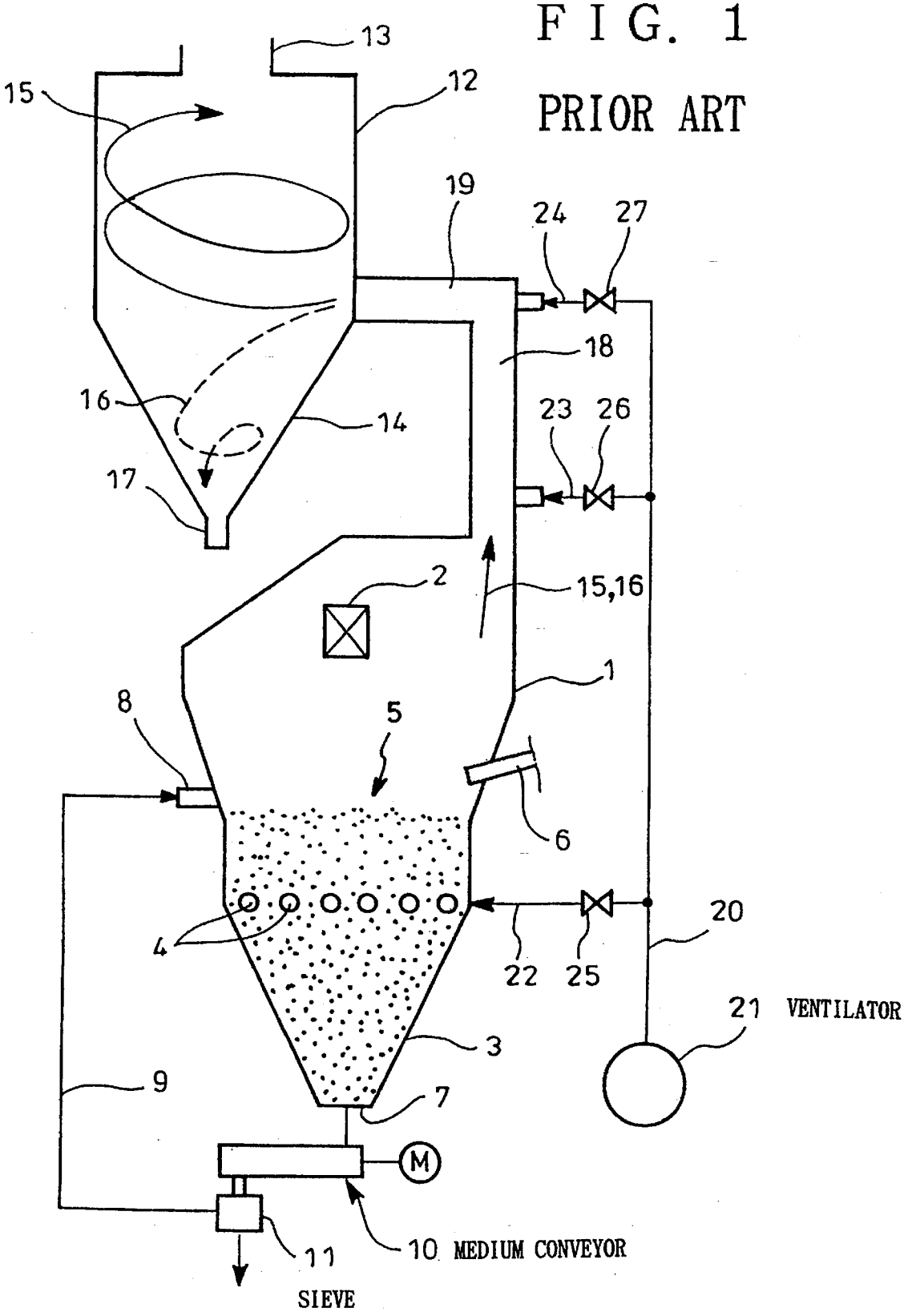
FIG. 1 PRIOR ART
FIG. 1 is a schematic, sectional side elevation of the above-mentioned combustion apparatus with the secondary combustion chamber.
Figure 2:
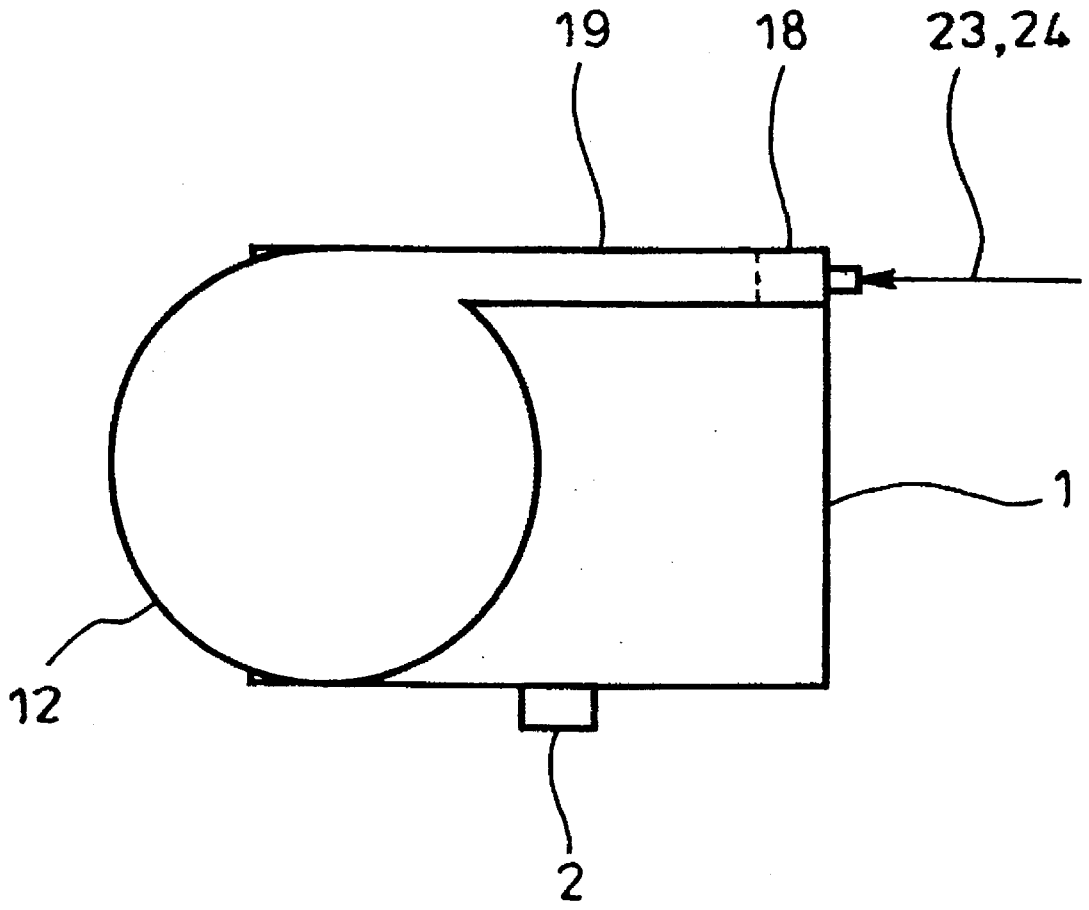
FIG. 2 PRIOR ART
FIG. 2 is a plan view of FIG. 1.
Figure 3:
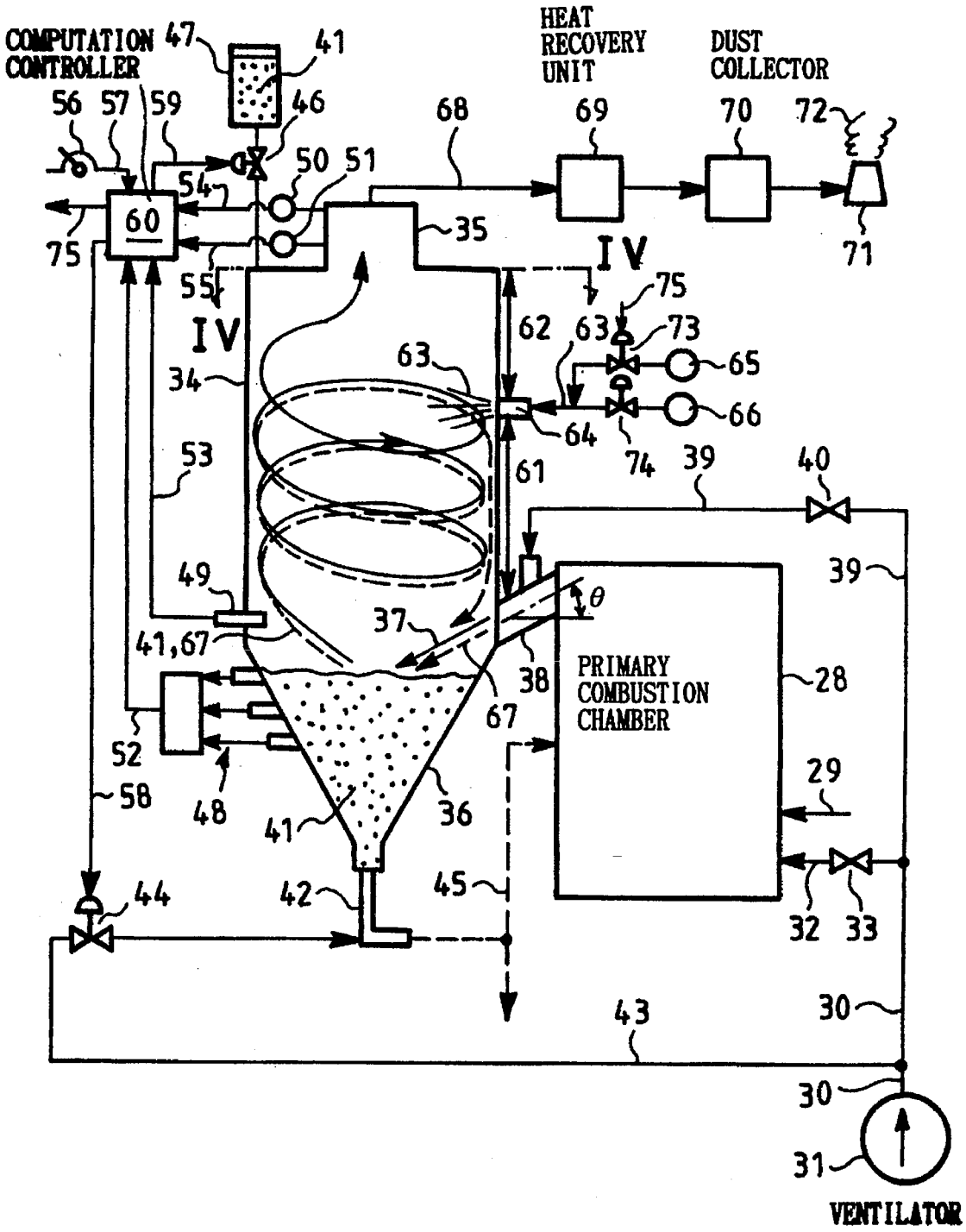
FIG. 3 is a schematic, sectional side elevation of a first embodiment according to the present invention.
Figure 4:
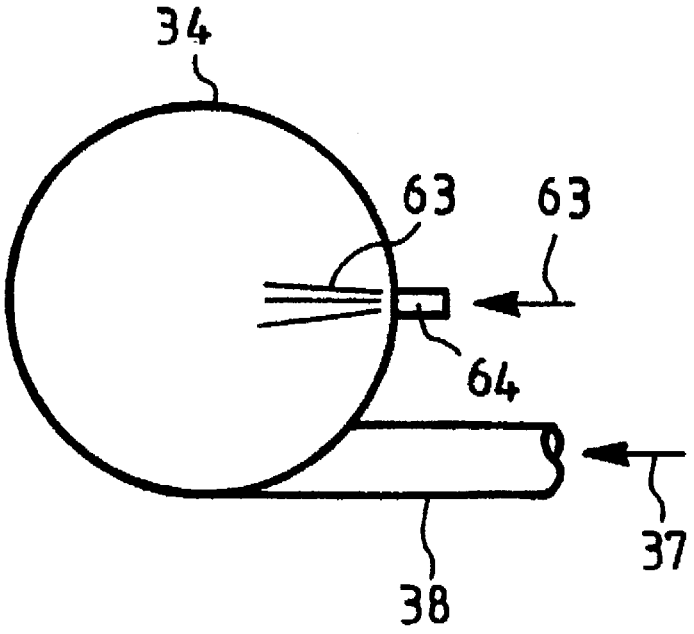
FIG. 4 is a view looking in the direction of arrows IV—IV in FIG. 3.

In the figures, reference numeral 28 represents a primary combustion chamber; and 29, fuel to be supplied to the chamber 28. Here, the primary combustion chamber 28 is not limited to a fluidized bed combustion furnace as shown in FIG. 1 and may be a combustion chamber in general such as a stoker fired furnace, a boiler, a large-sized diesel engine in which combustion gas is generated.

Reference numeral 30 represents an air passage for supplying air from a ventilator 31 arranged externally; 32, a primary air passage branched off from the passage 30 for supplying the air to the chamber 28; and 33, a valve in the midway of the passage 32.

Provided above or a side of the primary combustion chamber 28 is an independent, secondary combustion chamber 34 having a cylindrical side wall. The chamber 34 has a gas outlet 35 at its axial center on its upper end and a hopper 36 on its lower portion.

Further, a gas inlet 38 for guiding unreacted gas 37 (gas before the reaction in the chamber 34) generated in the chamber 28 to the chamber 34 is connected between the upper portion of the chamber 28 and the lower portion of the side wall of the chamber 34. Connection of the inlet 38 to the chamber 34 is in a tangential direction and, if necessary, with a descending gradient. Optimally, an angle θ of the inlet 38 to the horizontal is about 30 degrees.

Reference numeral 39 represents a secondary air passage branched off from the passage 30 for supplying the air to the gas inlet 38; and 40, a valve in the midway of the passage 39.

According to this first embodiment, bulk material 41 is stacked in the hopper 36 nearly up to the level of the gas inlet 38 and a drawing mechanism 42 such as L-shaped valve for drawing the material 41 out of the chamber is mounted on the lower end of the hopper 36. Connected between the passage 30 and the mechanism 42 is a drawing air passage 43. A bulk material level regulating valve 44 is in in the midway of the passage 43.

The bulk material 41 used to be stacked in the hopper 36 is, for example, fluidization sand such as plain or silica sand, gulanulated desulfurizing or denitrating agent or mixture of the fluidization sand with the gulanulated desulfurizing or denitrating agent.

In the case where the primary combustion chamber 28 is designed as fluidized bed, the same fluidization sand as that of the chamber 28 may be used as the bulk material 41 in the hopper 36 of the secondary combustion chamber 34 and may be drawn through the mechanism 42 to the chamber 28 as shown by an arrow 45.

For the secondary combustion chamber 34, a bulk material feeder or hopper 47 (or denitrating agent feeder or hopper, as the case may be) is arranged via a bulk material feed valve 46 (or denitrating agent feed valve, as the case may be). Though the feeder 47 may be installed at any position, it is preferable to install it on the upper end of the chamber 34 and along the wall of the chamber 34 from the viewpoint of attaining an effect of cleaning up inside the chamber 34.

A bulk material level sensor 48 is mounted on the hopper 36 into which the bulk material 41 is stacked. A temperature sensor 49 is mounted, at approximately the same height as the mounting position of the gas inlet 38, on the lower portion of the side wall of the chamber 34.

The sensor 49 may be mounted at any position, but it is preferable to mount it at the position as described above since temperature in the chamber 34 reaches maximum at that position.

If necessary, sensors 50 and 51 for sensing carbon monoxide concentration and nitrogen oxide concentration, respectively, may be mounted on the gas outlet 35 at the upper end of the chamber 34.

Though the sensors 50 and 51 may be mounted at any positions, it is preferable to mount them at the position as described above. Since the control operation by these sensors 50 and 51 may be partially overlapped with the control by the temperature sensor 49, beth of the sensors 50 and 51 maybe omitted or only one of them may be provided.

Further, a computation controller 60 is provided which receives a sensed level signal 52, a sensed temperature signal 53, a sensed carbon monoxide concentration signal 54 and a sensed nitrogen oxide concentration signal 55 from the sensors 48, 49, 50 and 51, respectively, and compares these signals with input signals 57 of, for example, reference level, reference temperature, reference carbon monoxide concentration and reference nitrogen oxide concentration from an input setting unit 56 to issue a control signal 58 to the bulk material level regulating valve 44 and also issues a control signal 59 to the bulk material feed valve 46, and further, if necessary, issues a control signal 75 to a flow rate regulating valve 73 (denitrating agent feed valve) as described later.

The reference level, the reference temperature, the reference carbon monoxide concentration and the reference nitrogen oxide concentration may be specific values or may be values within certain ranges with upper and lower limits.

A complete combustion zone 61 is provided in the lower portion of the side wall of the chamber 34 and a chemical agent reaction zone 62 is provided in the upper portion of the chamber 34. In this embodiment, it is designed such that the unreacted gas 37 passes through the chamber 34 over a period of about 2 seconds, of which the time of about 1.5 seconds corresponds to the zone 61 and the remaining time of 0.5 second corresponds to the zone 62.

Mounted on the side wall of the chamber 34 at a boundary between the zones 61 and 62 is an injection nozzle 64 for injecting chemical agents 63 such as denitrating and desulfurizing agents to the axial center of the chamber 34. To the nozzle denitrating and desulfurizing agent tanks or feeders 65 and 66 are connected via flow rate regulating valves 73 and 74 (denitrating and desulfurizing agent feed valves), respectively. A plurality of injection nozzles 64 may be provided separately for each of the denitrating and desulfurizing agents. The nozzle 64 may be designed to inject a chemical agent or agents other than the above agents. In the case where the gulanulated denitrating and/or desulfurizing agent or agents are used as the bulk material 41 or it or they are mixed in the material 41, there is no need to provide the nozzle or nozzles 64.

In the figures, reference numeral 67 represents unburnt solids such as char entrained in the unreacted gas 37 generated in the chamber 28, which solids may partially contain ashes, as the case may be.

Reference numeral 68 represents an exhaust gas duct connected to the gas outlet 35; 69, a heat recovery unit in the midway of the duct 68; 70, a dust collector at an exit side of the unit 69, which may be provided as needs demand; 71, a chimney on an exit side of the dust collector 70 for discharging the exhaust gas 72 to the atmosphere.

Next, mode of the operation will be described.

The air from the ventilator 31 is supplied to the primary combustion chamber 28 via the passages 30 and 32 and the fuel 29 is burnt.

The unreacted gas 37 generated by the combustion in the chamber and in the incompletely burnt state is sent tangentially and with a downward gradient of about 30 degrees to the generally cylindrical chamber 34 via the gas inlet 38. In the middle of the way, it is mixed with the air from the ventilator 31 supplied via the passages 30 and components of the unreacted gas 37 generated in the primary combustion chamber 28 varies according to the type of the chamber 28 such as fluidized bed combustion furnace, stoker fired furnace, boiler, large-sized diesel engine or other combustion chambers.

Figure 5:
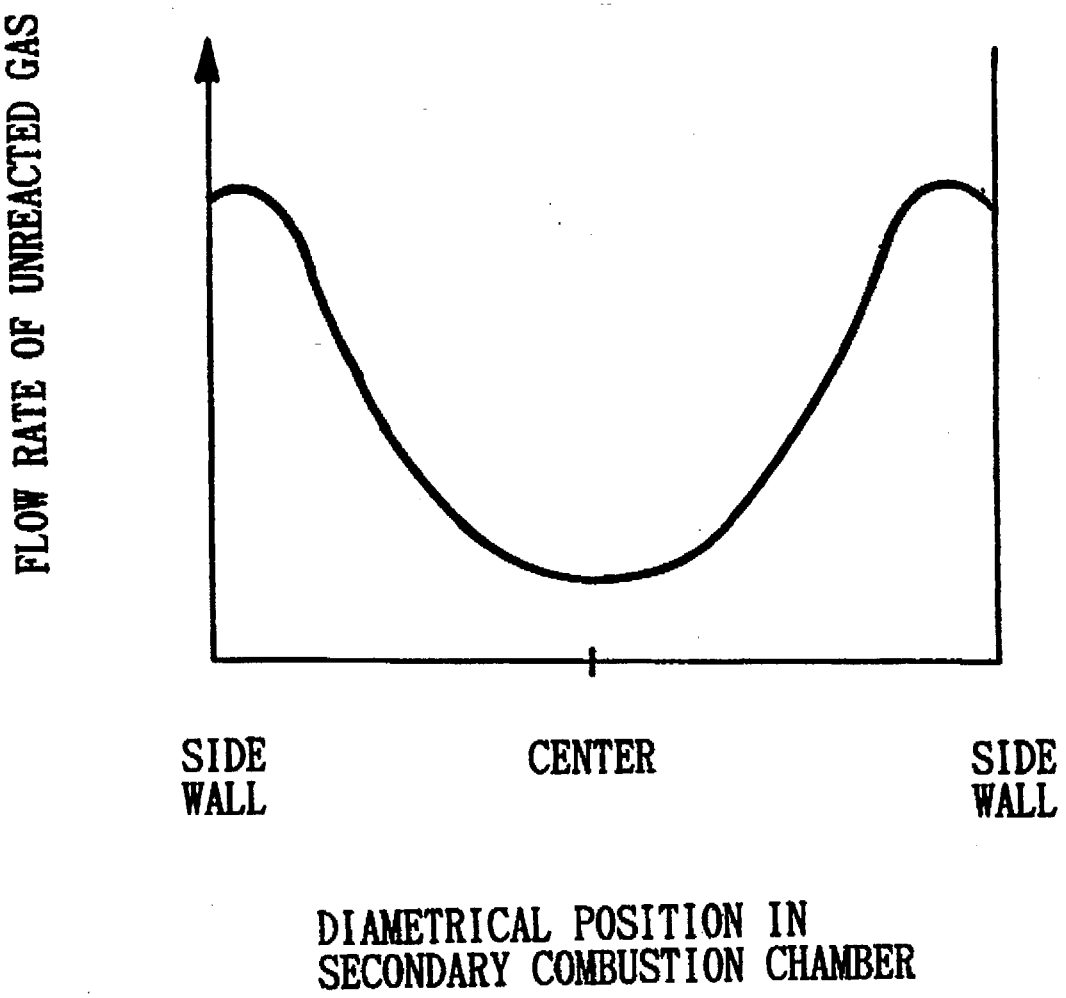
FIG. 5 is a diagram showing the relationship between diametrical position in the secondary combustion chamber and flow rate of unreacted gas.

Since, according to the present invention, the bulk material 41 is stacked in the hopper 36 nearly up to the height of the gas inlet 38, the unreacted gas 37 introduced tangentially and in the downward direction to the chamber 34 first hits the material 41 stacked in the hopper 36 inside the chamber 34, blows up the same upwardly and forms a spiral ascending flow along the side wall of the chamber 34 as shown in the diagram of FIG. 5.

The downward inclination of the gas inlet 38 will increase dispersed quantity of the bulk material 41 in the chamber. However, even when the gas inlet 38 is designed to be directed horizontally, the material 41 can be blown upward to sufficient extent.

The spiral ascending flow further promotes mixing of the unreacted gas 37 with the air. By the spiral flow, sufficient retention time can be assured for the unreacted gas 37 in the chamber 34.

As a result, the unreacted gas 37 is completely burnt to suppress generation of harmful substances such as dioxin due to incomplete combustion.

The time of the unreacted gas 37 to pass through the chamber 34 is set to about 2 seconds and the unreacted gas 37 is completely burnt in about 1.5 seconds as it passes through the first zone 61.

Similarly, the unburnt solids 67 such as char, which enters through the inlet 38 into the chamber 34 together with the unreacted gas 37, rises up spirally along an inner wall of the chamber 34 while entrained in the spiral ascending flow of the gas 37.

After rising up together with the unreacted gas 37, the unburnt solids 67 are separated from the gas 37 in the upper portion of the chamber 34 since the flow velocity of the spiral ascending flow of the unreacted gas 37 decreases. The solids 67 fall by their own weight and go up again together with the upstream spiral ascending flow with higher velocity. Thus, the solids are circulated in the secondary combustion chamber 34, which leads to formation of an internal circulating flow of the unburnt solids 67 in the chamber 34.

This internal circulating flow makes the retention time of the unburnt solids 67 in the chamber sufficiently longer, thereby promoting combustion of the unburnt solids 67.

Figure 6:
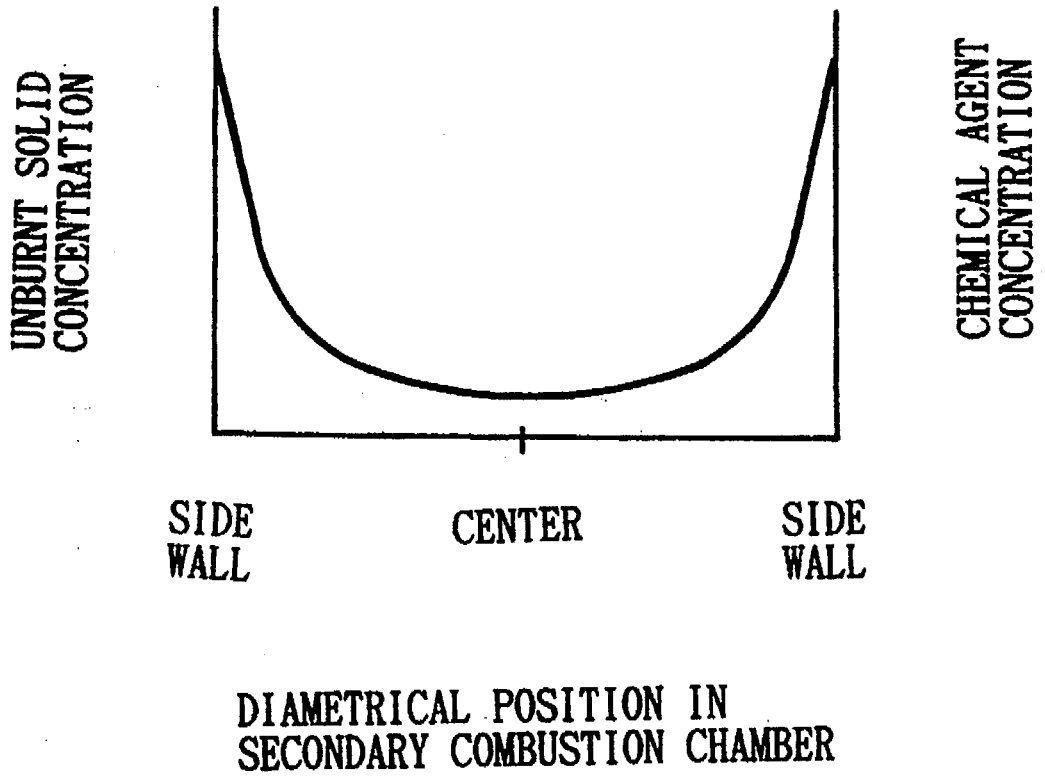
FIG. 6 is a diagram showing the relationship between diametrical position in the secondary combustion chamber and unburnt solid and chemical agent concentrations.

Moreover, the unreacted solids 67 are brought together along the inner wall of the chamber 34 due to centrifugal force of the spiral ascending flow as shown in the diagram of FIG. 6. In such group of the unburnt solids 67 with elevated particle concentration along the inner wall of the chamber 34, surfaces of the unburnt solids 67 are removed by the bulk material 41 which is circulated together with the unburnt solids 67 along with the internal circulating flow, and new surfaces of the unburnt solids 67 constantly appear, which promotes combustion of the unburnt solids 67.

As described above, even when the unburnt solids are difficult to burn, the better condition for combustion can be attained, which may be ten or more times as great as that of the conventional apparatus. In the apparatus shown in FIG. 1, the combustion gas discharged from the gas outlet 13 on the upper end of the secondary combustion chambers 12 still contains carbon monoxide of about 10 ppm as shown by line C in FIG. 8 whereas, in the present invention, the combustion gas from the gas outlet 35 on the upper end of the secondary combustion chamber 34 contains carbon monoxide of less than 1 ppm or substantially as small as 0 ppm.

In addition, as shown in the diagram of FIG. 6, the unburnt solids 67 and the bulk material 41 make intensively flow along the side wall of the secondary combustion chamber 34 because of the centrifugal force, which provides an effect of cleaning up inside the secondary combustion chamber 34.

The arrangement of the present invention to stack the bulk material 41 in the hopper 36 is especially suitable for the case where the secondary combustion chamber 34 is designed in smaller size.

No special control operation is required for the level of the bulk material 41 stacked in the hopper 36 or dispersed quantity of the material 41 inside the chamber so as to attain good burning condition as described above. However, the following control may be performed to accomplish the better combustion.

Specifically, the temperature of the portion (where the temperature reaches the highest value) at approximately the same height as the mounting position of the gas inlet 38 on the lower portion of the side wall of the secondary combustion chamber 34 is sensed by the temperature sensor 49. A sensed temperature signal 53 from the sensor 49 is sent to the controller 60 which compares it with an input signal such as reference temperature from the input setting unit 56.

In a case where the comparison reveals the value of the sensed temperature signal 53 to be higher than the reference temperature, the controller 60 issues a control signal to the feed valve 46 to open the valve 46 to charge a large quantity of cool bulk material 41 in the feeder 47 into the hopper 36, thereby decreasing the temperature of the chamber 34 and preventing the unburnt solid 37 and/or ashes from being molten and attached to the inner wall of the chamber 34. This is because, when the chamber 34 is too hot, there is a possibility that unburnt solids 67 such as char having low melting point and introduced together with the unreacted gas 37, ashes introduced into the chamber 34 together with the unburnt solids 67 and/or ashes generated from the combustion of the unburnt solids 67 may be molten and attached on the inner wall of the chamber 34.

With the bulk material feeder 47 being installed along the chamber wall at the upper end of the chamber 34, the bulk material 41 falls along the inner wall of the chamber 34, which attains an effect of cleaning up inside the chamber 34.

In general, increase of temperature in the chamber will tend to increase quantity of nitrogen oxides generated. Charging of a large quantity of the cool bulk material 41 into the chamber to decrease the temperature in the chamber can suppress generation of nitrogen oxides. Moreover, if the charged bulk material 41 is granulated denitrating agent of is a mixture with the granulated denitrating agent, the granulated denitrating agent further contributes to decreasing the quantity of nitrogen oxides generated. When no gulanulated denitrating agent is not contained in the bulk material 41, the computation controller 60 may issue a control signal 75 to the flow rate regulating valve 73 (denitrating agent feed valve) so that the denitrating agent in the tank 65 is injected into the chamber through the nozzle 64 (or injected quantity is increased if already being injected).

On the contrary, in a case where the value of the sensed temperature signal 53 from the temperature sensor 49 is lower than the reference temperature, it means that combustion efficiency in the secondary combustion chamber 34 is in decreasing tendency. Thus, the computation controller 60 issues the control signal 58 to the valve 44 to send the air from the ventilator 31 to the drawing mechanism 42 via the passage 43, thereby discharging part of the bulk material 41 in the hopper 36 out of the chamber 34. As a result, the stacked quantity of the bulk material 41 in the hopper 36 is reduced and the temperature inside the chamber is increased, leading to increase the combustion efficiency.

In general, decrease of temperature in the chamber will tend to increase quantity of Carbon monoxide generated. Thus, the computation controller 60 issues the control signal 59 to the valve 46 to open the valve 46, thereby charging a small quantity of the bulk material 41 in the feeder 47 into the hopper 36. As a result, dispersed quantity of the bulk material 41 in the chamber 34 and combustion of the unburnt solids 67 is promoted, thereby suppressing the generation of carbon monoxide.

Similarly, concentration of carbon monoxide is sensed by the sensor 50 at the gas outlet 35 in the chamber 34 and the sensed carbon monoxide concentration signal 54 from the sensor 50 is sent to the computation controller 60 which compares it with the input signal 57 such as the reference carbon monoxide concentration from the input setting unit 56.

In a case where the comparison reveals that the value of the sensed carbon monoxide concentration signal 54 is higher than the reference carbon monoxide concentration, it moans that the dispersed quantity of the bulk material 41 in the chamber is in shortage and combustion performance of the unburnt solids 67 is low. Thus, the computation controller 60 issues the control signal 59 to the feed valve 46 to open the valve 46 and to charge a small quantity of the bulk material 41 in the feeder 47 into the hopper 36. This increases dispersed quantity of the bulk material 41 in the chamber 34 and promotes decomposition and combustion of the unburnt solids 67.

In a case where the quantity of carbon monoxide generated increases, the temperature in the furnace may be decreased as mentioned above. Thus, the stacked quantity of the bulk material 41 in the hopper 36 may be reduced to increase the temperature in the chamber.

On the contrary to the above, in a ease where the value of the sensed carbon monoxide concentration signal 54 is lower than the reference carbon monoxide concentration, it means that the combustion condition is good and there is no need to perform control operation. Or, the level of the bulk material 41 in the hopper 36 maybe adjusted to reference level during this period.

Similarly, concentration of nitrogen oxides is sensed by the sensor 51 at the gas outlet 35 on the secondary combustion chamber 34 and a sensed nitrogen oxide concentration signal 55 from the sensor 51 is sent to the computation controller 60 which compares it with an input signal 57 such as reference nitrogen oxide concentration from the input setting unit 56.

In a case where the comparison reveals that the value of the sensed nitrogen oxide concentration signal 55 is higher than the reference nitrogen oxide concentration, the computation controller 60 issues a control signal 75 to the flow rate regulating valve 73 (denitrating agent feed valve) and injects the denitrating agent in the tank or feeder 65 through the nozzle 64 into the furnace (the injection quantity is increased, if already being injected), thereby decreasing the nitrogen oxides.

In this case, if a small quantity of the bulk material 41 in the feeder 47 is charged into the hopper 36, the effect of decreasing nitrogen oxides by the denitrating agent is increased due to the bulk material 41.

When the bulk material 41 is granulated denitrating agent or is a mixture with granulated denitrating agent, the control signal 59 is sent to the bulk material feed valve 46 (denitrating agent feed valve) to open the valve 46 and to charge a small quantity of the bulk material 41 in the feeder 47 into the hopper 36, thereby decreasing the quantity of nitrogen oxides.

Further, in a case where the quantity of nitrogen oxides generated increases, the temperature in the chamber may be increased as mentioned above. Thus, a large quantity of the cool bulk material 41 may be charged to decrease the temperature in the chamber.

On the contrary to the above, in a case where the value of the sensed nitrogen oxide concentration signal 55 is lower than the reference nitrogen oxide concentration, it means that the combustion condition is good and there is no need to perform control operation. Or, the level of the bulk material 41 in the hopper 36 may be adjusted to reference level during this period.

When the temperature sensor 49 is provided, there is no special need to install the sensors 50 and 51 for carbon monoxide and nitrogen oxide concentrations. However, one of the sensors 50 and 51 may be installed or both of them may be installed.

The level of the bulk material 41 in the hopper 36 is monitored through the sensor 48 by the computation controller 60 and is controlled in such manner as to finally return to the reference level. When the primary combustion chamber 28 is designed as fluidized bed combustion chamber and the bulk material 41 is the same fluidization sand as in the chamber 28, the bulk material 41 drawn through the drawing mechanism 42 may be sent to the chamber 28 as shown by an arrow 45.

Time periods for opening the valves 44 and 46 by the control signals 58 and 59 may be controlled by a timer or the like (not shown) which is installed in the controller 60.

The combustion gas generated in the complete combustion zone 61 by the combustion of the unreacted gas 37 and the unburnt solids 67 passes through the chemical agent reaction Zone 62 over a period of about 0.5 second.

In this case, from the injection nozzle or nozzles 64 on the side wall at the boundary between the zones 61 and 62, a chemical agent or agents 63 such as denitrating and desulfurizing agents in the tanks 65 and 66 are injected toward the axial center in the chamber 34 by manual operation or by a control signal 75 from the computation controller 60 as described above.

As a result, mixing of the chemical agent 63 with the combustion gas which has been completely burnt through the spiral ascending flow is promoted and denitration or desulfurization of the combustion gas or decomposition of dioxin are performed without catalyst. As shown in the diagram of FIG. 6, the chemical agent 63 intensively flows along the side of the secondary combustion chamber 34 together with the spiral ascending flow and is efficiently mixed with the combustion gas.

As the denitrating and desulfurizing agents, urea and calcium carbonate may be used, respectively. These agents may be injected in the form of aqueous solution or in powder.

The position of injecting the chemical agent 63 is set to the boundary between the complete combustion zone 61 and the chemicals reaction zone 62. It is because, if it were set in the complete combustion zone 61, then the unreacted gas 37 might react with the chemical agent 63 to generate harmful substances; if it were set closer to an exit side of the chemical agent reaction zone 62, the chemical agent might not be mixed well with the combustion gas and reaction might not be efficiently carried out due to the temperature of the combustion gas at the injecting position being out of the optimal range for denitrating reaction, i.e., 850°–950° C.

Figure 7:
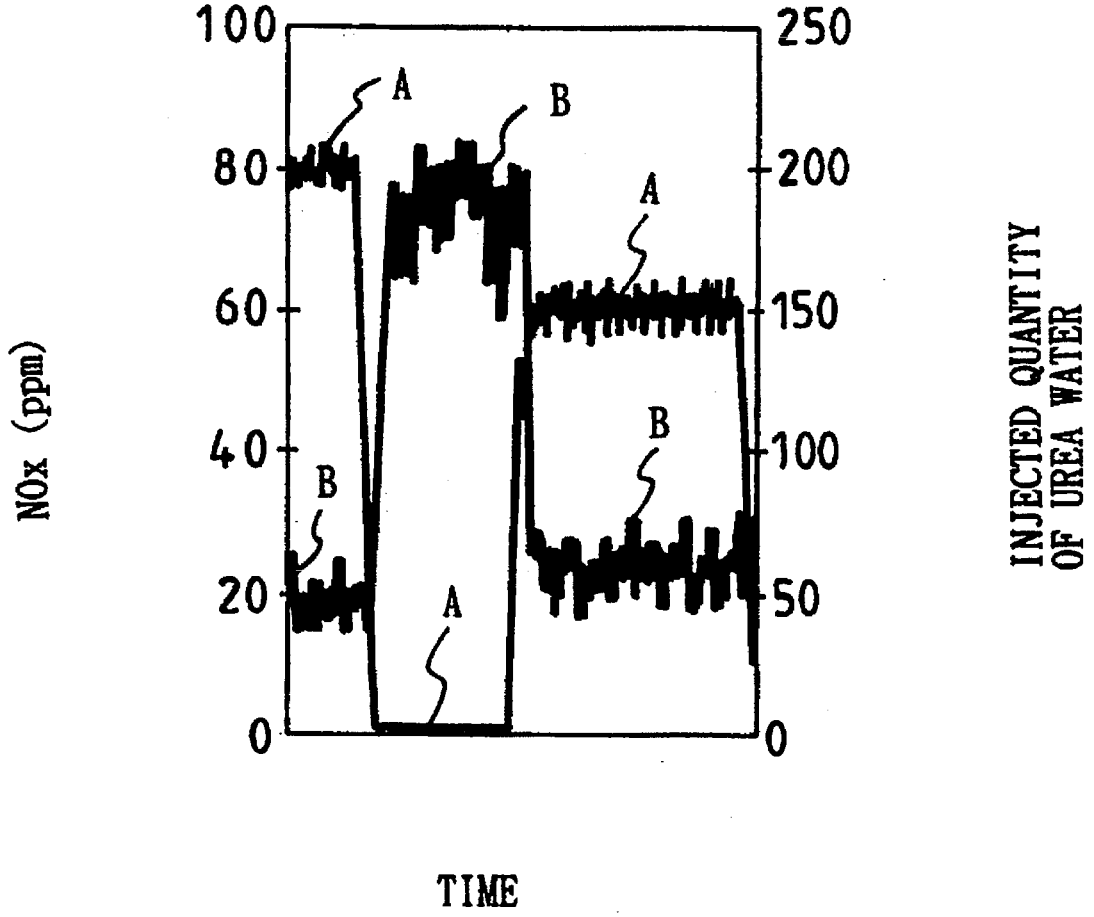
FIG. 7 is a diagram showing the relationship between injected quantity of urea water and quantity of NOx over time.
Figure 8:
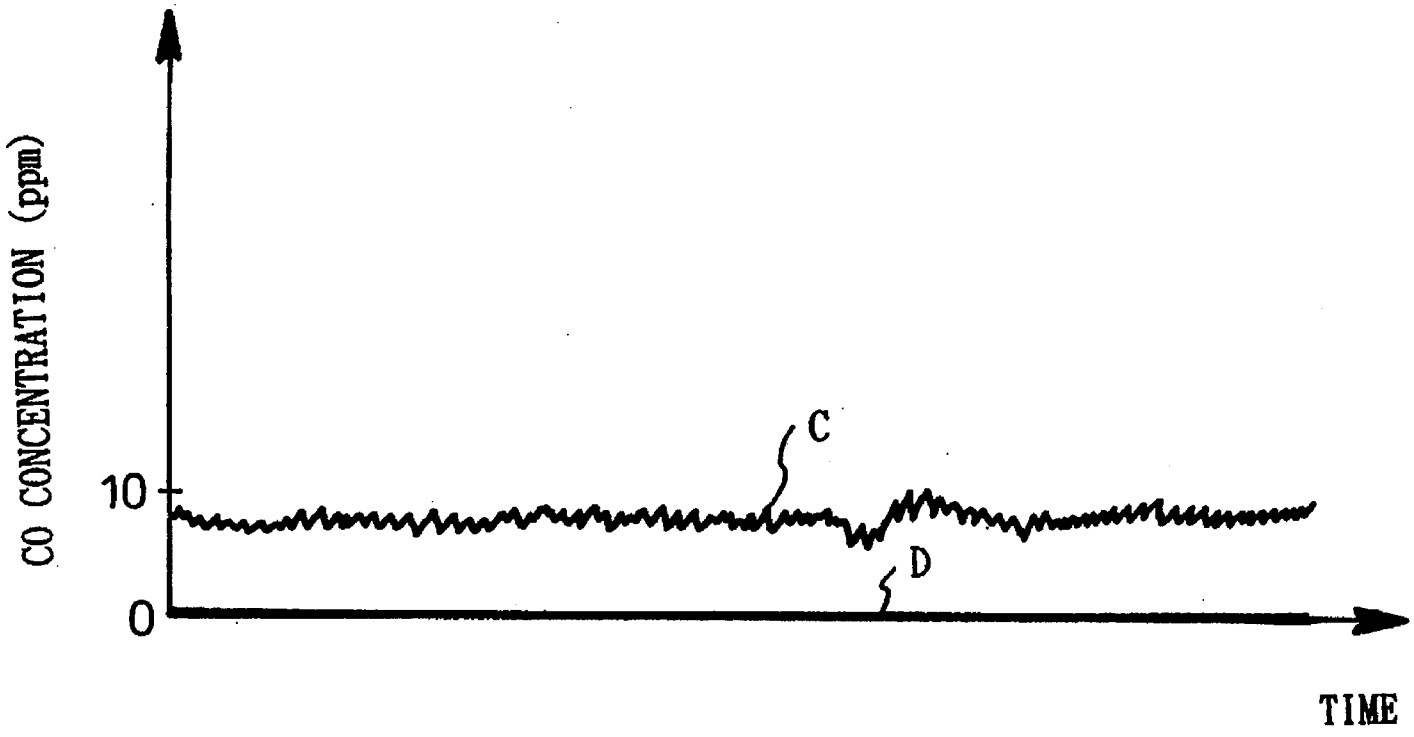
FIG. 8 is a diagram showing the relationship between time and CO concentration in combustion gas discharged from the secondary combustion chamber.

FIG. 7 shows experimental data in a case where urea water is injected as denitrating agent. As shown by line A, when fed quantity of the urea water is reduced from about 200 ml/min to 0 ml/min and is then raised to about 150 ml/min, the concentration of generated nitrogen oxides (NOx) increases from 20 ppm to about 75 ppm and is then decreased to 25 ppm. This supports the fact that the injection of the chemical agent 63 at the boundary between the zones 61 and 62 is effective.

After being denitrated and desulfurized in the zone 62, the combustion gas is discharged through the gas outlet 35 at the upper end of the chamber 34 to the exhaust gas duct 68. After heat has been recovered in the heat recovery unit 69, dust is collected by the dust collector 70 and the gas is discharged through the chimney 71 as exhaust gas 72 into the atmosphere.

Figure 9:
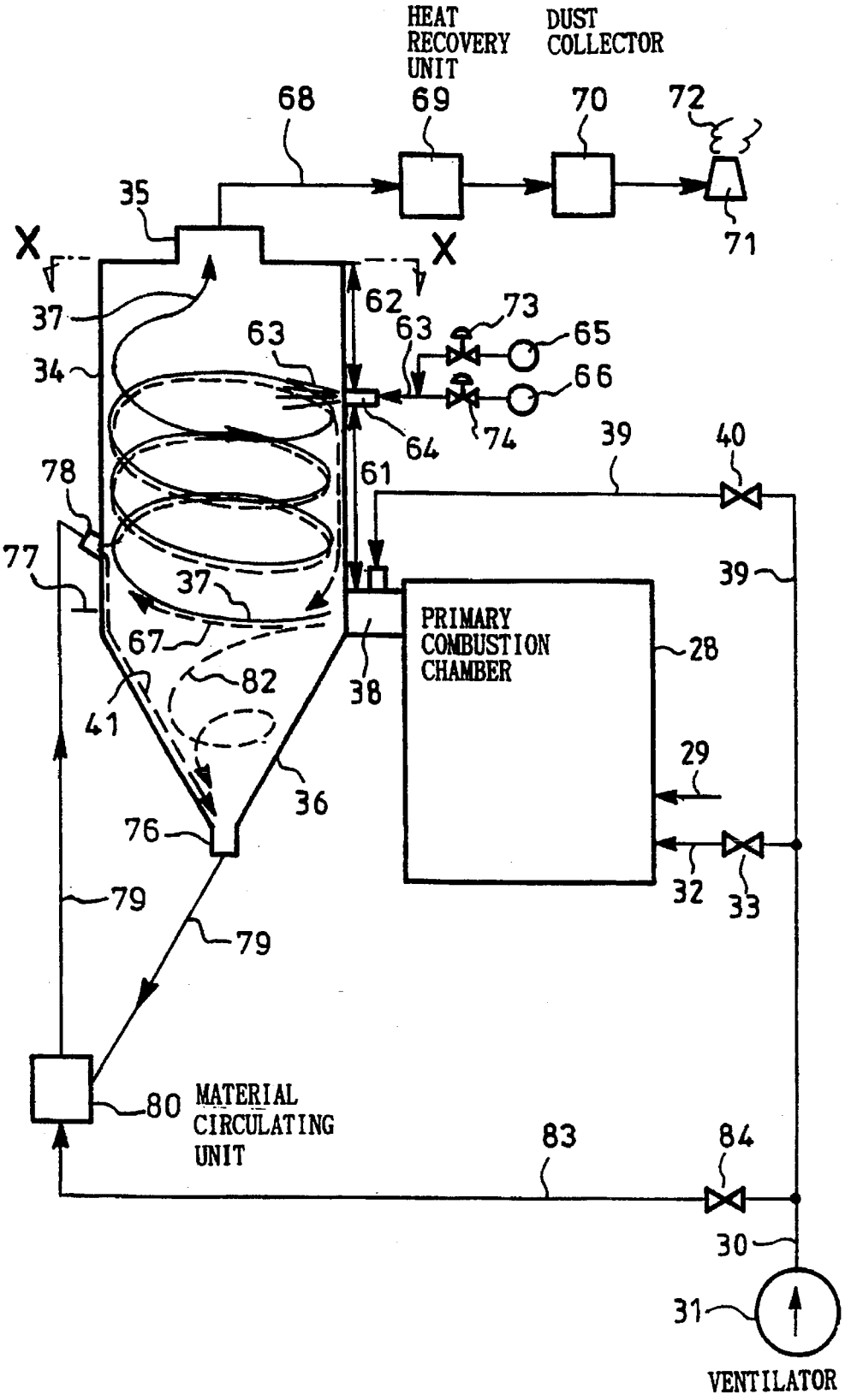
FIG. 9 is a schematic, sectional side elevation of a second embodiment of the present invention.
Figure 10:
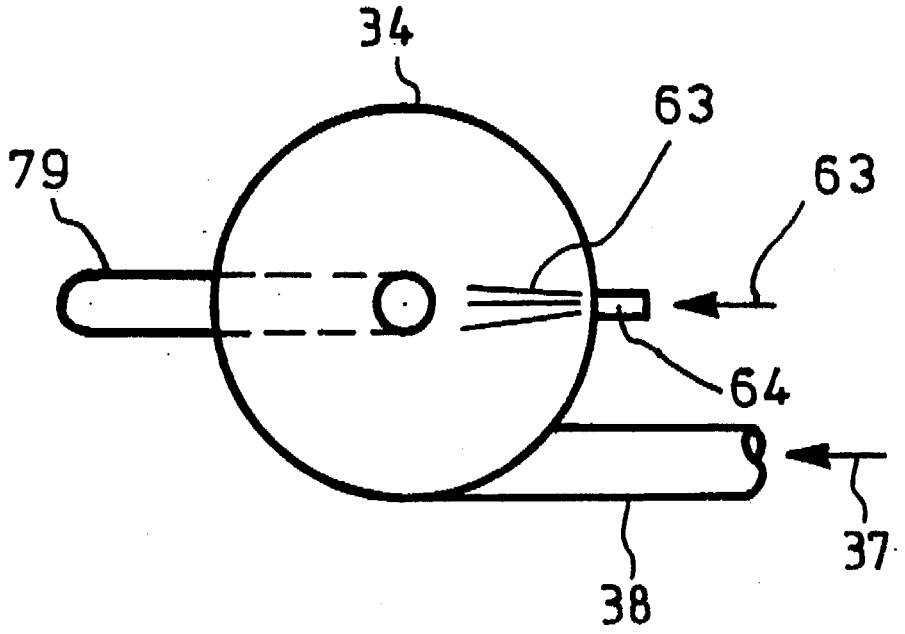
FIG. 10 is a view looking in the direction of arrows X—X in FIG. 9.

FIGS. 9 and 10 represent a second embodiment of the invention.

In this embodiment, a bulk material circulating passage 79 for the secondary combustion chamber 34 for externally circulating the bulk material 41 is connected between a bulk material outlet 76 at the lower end of the hopper 36 of the chamber 34 and a bulk material inlet 78 which is provided at a downstream position higher than the connecting position 77 of the gas inlet 38 on the side wall of the chamber 34 and a bulk material circulating unit 80 such as air handling equipment or bucket elevator is provided in the circulating passage 79. FIG. 9 shows a case where an air handling equipment is used as the bulk material circulating unit 80.

Reference numeral 83 represents an air passage for feeding air from the passage 30 to the air handling equipment in a case where the air handling equipment is used as the bulk material circulating unit 80; 84, a valve in the middle of the passage 83. The air handling equipment blows the bulk material in the passage 79 up to the bulk material inlet 78 by force of the air from the passage 30.

Except the above, this embodiment has the same arrangement as the first embodiment.

In this embodiment, when the air from the ventilator 31 is sent to the circulating unit 80 such as air handling equipment via the air passage 83, the bulk material 41 in the passage 79 is blown by force of the air up to the inlet 78 higher than the connecting position 77 of the gas inlet on the side wall of the chamber 34 and is Sent into the chamber 34 through the inlet 78.

The bulk material 41 sent into the chamber 34 through the inlet 78 is partially blown upward together with the unreacted gas 37 in the chamber 34 and forms an internal circulating flow together with the unburnt solids 67 in the chamber 34, thereby promoting combustion of the unburnt solids 67.

The remaining bulk material 41 goes down in the hopper 36 by its own weight and is taken out through the outlet 76 to the circulating passage 79 and is then circulated externally with respect to the chamber 34.

In this case, the hopper 36 is cleaned up by the bulk material 41 which fails through it.

On the other hand, from the unburnt solids 67 in the unreacted gas 37, which enters the chamber 34 through the gas inlet 38, coarse particles, i.e. unburnt coarse particles 82, are separated by centrifugal force and fall down in the hopper 36.

The unburnt coarse particles 82 are then externally circulated through the circulating passage 79 together with the bulk material 41 and are pulverized by the bulk material 41 in the circulating passage 79. The particles 82 pulverized to some extent by the bulk material 41 are entrained in the internal circulating flow generated in the chamber 34 and are completely burnt.

The arrangement to circulate the bulk material 41 externally with respect to the chamber 34 in this embodiment is especially suitable for the case where the secondary combustion chamber 34 is designed in larger size.

Except the above and as concerns the arrangement of this embodiment same as that of the first embodiment, the same operating effects can be attained as in the first embodiment.

Figure 11:
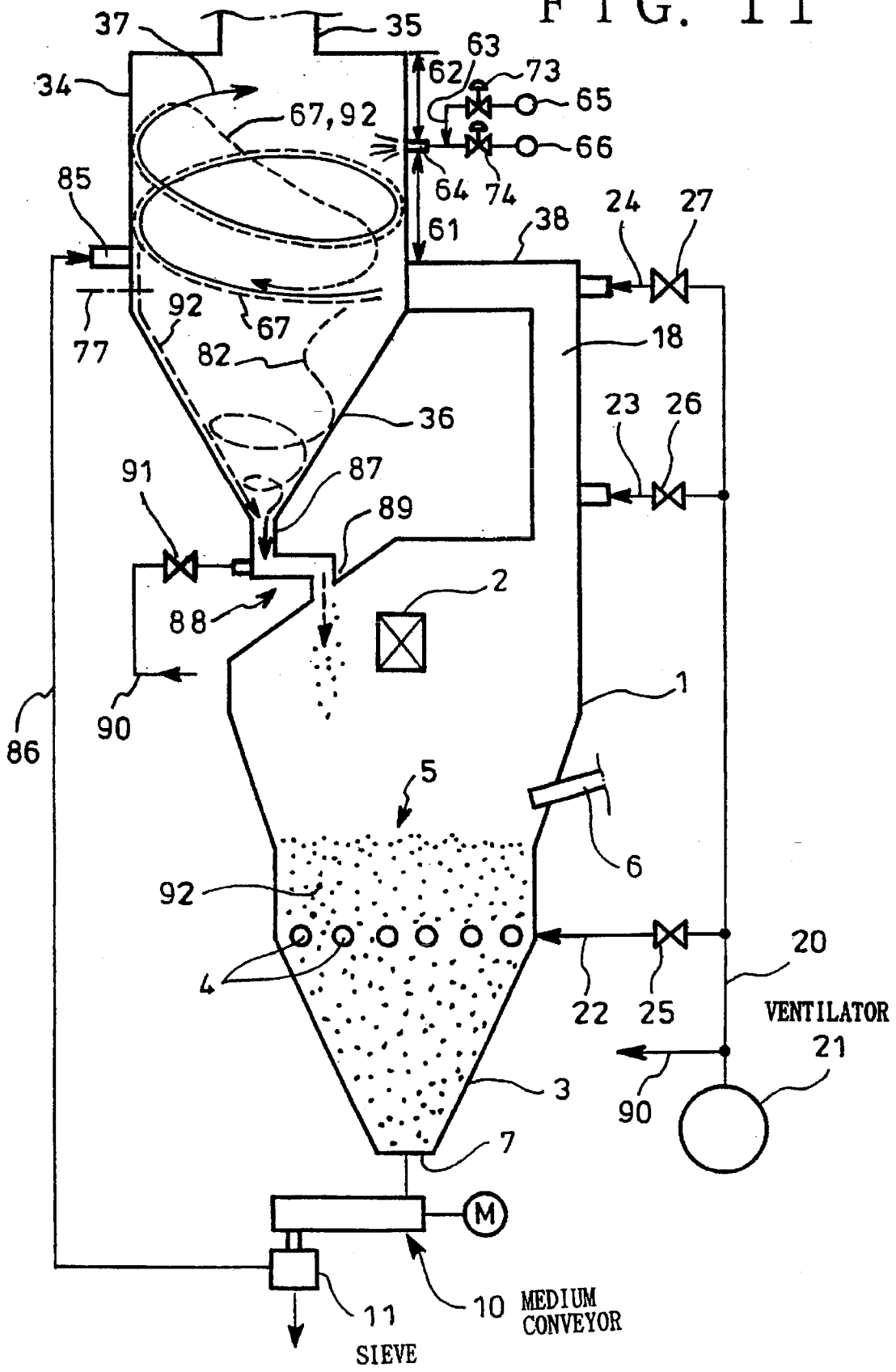
FIG. 11 is a schematic, sectional side elevation of a third embodiment of the present invention.

FIG. 11 represents a third embodiment of the present invention.

This embodiment is an application where the primary combustion chamber 1 is designed as fluidized bed furnace as shown in FIG. 1. A medium circulating passage 86 such as bucket elevator is connected between a medium outlet 7 at a lower end of the primary combustion chamber 1 and a medium inlet 85 at a downstream position higher than the connecting position 77 of the gas inlet 38 on the side wall of the secondary combustion chamber 34.

Also, a medium outlet 87 at a lower end of the secondary combustion chamber 34 is connected to a medium inlet 89 of the chamber 1 via a drawing mechanism 88 such as L-shaped valve.

In the figure, reference numeral 90 represents an sealing air passage for connecting the passage 20 to the drawing mechanism 88; 91, a valve in the midway of the passage 90; and 92, the fluidization medium (bulk material).

Except the above, this third embodiment has the same arrangement as that of the first or second embodiment.

In this embodiment, the medium 92, which constitutes a fluidized bed 5 in the first combustion chamber 1, is sent to the secondary combustion chamber 34 via the medium circulating passage 86 and is externally circulated. By utilizing the medium 92 used in the chamber 1 and without especially preparing the bulk material 41, it is possible to achieve complete combustion of the unburnt solids 67 in the chamber 34 as in the above embodiments and to clean up inside the chamber 34.

Except the above and as concerns the arrangement of this embodiment same as that of the first or second embodiment, the same operating effects can be attained as in the first or second embodiment.

In this case, the chamber 34 may have a complete combustion zone 61 and a chemicals reaction zone 62, and a chemical agent injection nozzle 64 for injecting denitrating and/or desulfurizing agent or agents from a tank 65 and/or 66 may be installed on the side wall at the boundary between the two zones.

Figure 12:
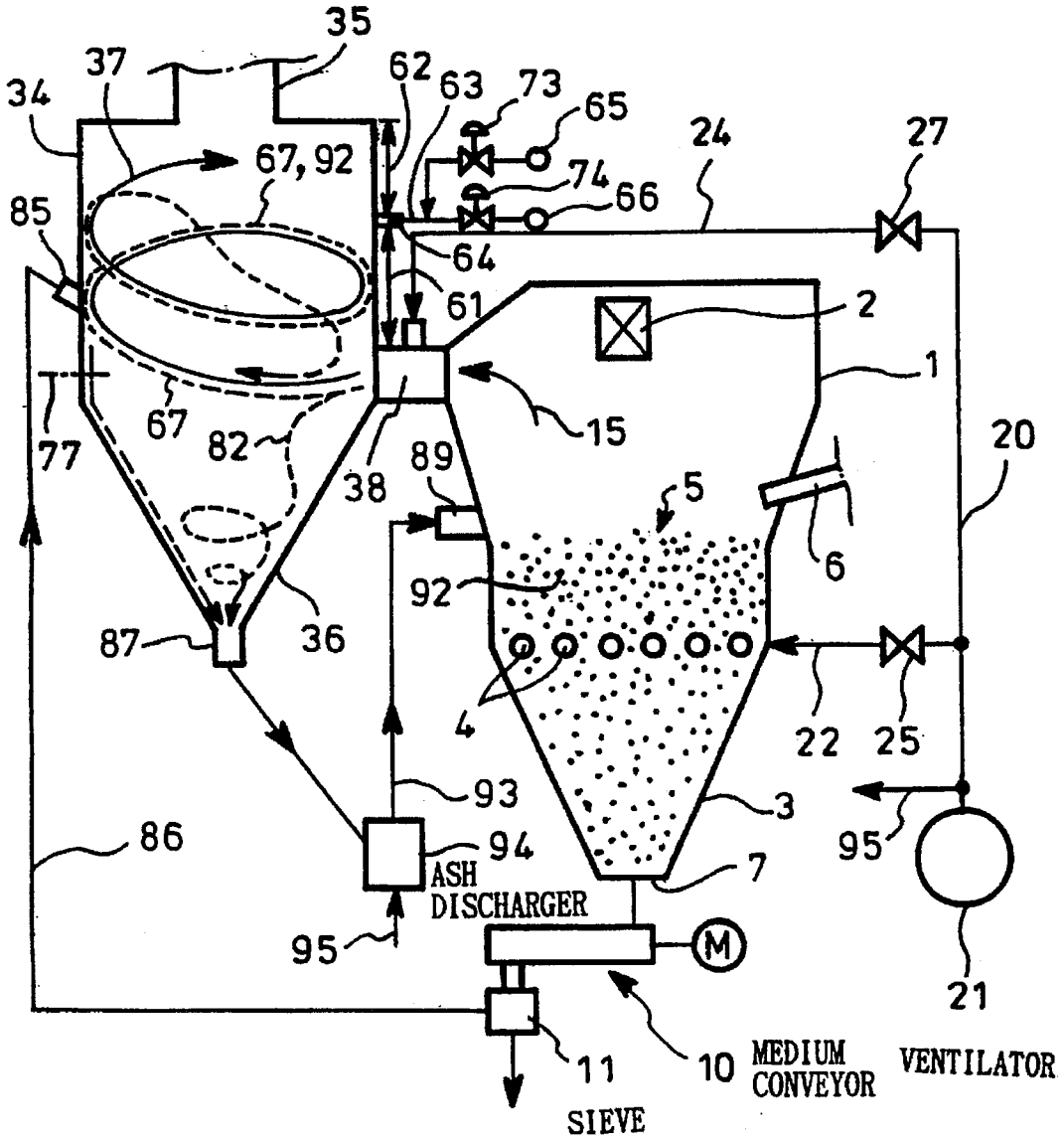
FIG. 12 is a schematic, sectional side elevation of a fourth embodiment of the present invention.

FIG. 12 represents a fourth embodiment of the present invention where the secondary combustion chamber 34 is arranged on a side of the primary combustion chamber 1.

In the figure, reference numeral 93 represents an ash discharge passage connected between a hopper 14 at a lower portion of the secondary combustion chamber 34 and the primary combustion chamber 1; 94, an ash discharger such as air handling equipment or bucket elevator in the midway of the ash discharge passage (FIG. 12 shows a case where air handling equipment is used); and 95, an ash discharging air passage for connecting between the passage 20 and the ash discharger 94.

Except the above, the arrangement is the same as in the first, second or third embodiment.

In this embodiment, the secondary combustion chamber 34 is arranged on a side of the primary combustion chamber 1, which contributes reduction in height of the entire apparatus.

Except the above and as concerns the arrangement of this embodiment same as that of the first, second or third embodiment, the same operating effects can be attained as in the first, second or third embodiment.

In this case, the secondary combustion chamber 34 may be constituted by a complete combustion zone 61 and a chemical agent reaction zone 62 and a chemical agent injection nozzle 64 for injecting denitrating and/or desulfurizing agent or agents from a tank 65 and/or 66 may be installed on the side wall at the boundary between the two zones.

It is needless to say that the present invention is not limited to the above embodiments and that various changes and modifications may be made without departing from the spirit and the scope of the present invention.

As described above, it is possible according to the present invention to attain superb effect to produce the better condition for complete combustion.

What is claimed is:

1. A combustion apparatus comprising a fluidized bed type primary combustion chamber, a secondary combustion chamber provided separately from the primary combustion chamber, a gas inlet for tangentially guiding unreacted gas with unburnt solids entrained therein generated in the primary combustion chamber and secondary air to a lower portion of a side wall of the secondary combustion chamber, a medium circulation passage for connecting a medium outlet on a lower end of the primary combustion chamber to the side wall of the secondary combustion chamber and a medium outlet on a hopper at the lower portion of the secondary combustion chamber connected to the primary combustion chamber, wherein a position of connecting the medium circulation passage to the side wall of the secondary combustion chamber is higher than a position of connecting the gas inlet to the side wall of the secondary combustion chamber.

2. The apparatus according to claim 1, wherein the secondary combustion chamber is provided above the primary combustion chamber.

3. The apparatus according to of claim 1, wherein the secondary combustion chamber has therein a lower complete combustion zone above the hopper as well as an upper chemical agent reaction zone, a chemical agent injection nozzle being mounted on the side wall of the secondary combustion chamber at a boundary between the zones so as to inject a denitrating agent.

4. The apparatus according to claim 1, wherein the secondary combustion chamber has therein a lower complete combustion zone above the hopper as well as an upper chemical agent reaction zone, a chemical agent injection nozzle being mounted on the side wall of the secondary combustion chamber at a boundary between the zones so as to inject a desulfurizing agent.

5. A combustion method comprising the steps of:

tangentially guiding unreacted gas admixed with air, with unburned solids entrained therein from a primary combustion chamber to a lower portion of a side wall of a generally cylindrical secondary combustion chamber;

generating a spiral ascending flow of the unreacted gas in the secondary combustion chamber to ensure a predetermined retention time of the gas so that the gas is completely burned;

forming a group of unburned solids with elevated particle concentration along the side wall of the secondary combustion chamber by centrifugal force of the spiral ascending flow which are flown upwardly by the combustion gas for circulation; and charging a fluidization medium into the side wall of the secondary combustion chamber to contact the medium with said group so that the fluidizing medium accompanies the group of the unburned solid with the elevated particle concentration, thereby contacting the unburned solids with the medium and completely burning the unburned solids.

* * * * *